US007001465B1

(12) United States Patent
Thomas

(10) Patent No.: US 7,001,465 B1
(45) Date of Patent: Feb. 21, 2006

(54) MIXING AND APPLICATION SYSTEM, METHOD AND MATERIAL

(76) Inventor: Michael B. Thomas, 7005 Organ Creek Rd., Pendleton, KY (US) 40055

( * ) Notice: Subject to any disclaimer, the term of this patent is extended or adjusted under 35 U.S.C. 154(b) by 0 days.

(21) Appl. No.: 10/667,999

(22) Filed: Sep. 22, 2003

(51) Int. Cl.
*B05C 3/132* (2006.01)

(52) U.S. Cl. ..... 118/420; 118/423; 118/428; 118/429; 118/DIG. 19; 118/642

(58) Field of Classification Search ..... 118/420, 118/423, 428, 429, DIG. 19, 641–643
See application file for complete search history.

(56) References Cited

U.S. PATENT DOCUMENTS 2,111,853 A * 3/1938 Fourness et al. ..... 118/667
2,527,465 A * 10/1950 Toulmin, Jr. ..... 118/67
3,291,639 A * 12/1966 Flowers et al. ..... 427/120
3,589,330 A * 6/1971 Alexeff ..... 118/688
3,607,498 A * 9/1971 Kubota ..... 156/116
6,630,018 B1 * 10/2003 Bauer et al. ..... 106/415
2004/0122131 A1 * 6/2004 Brown et al. ..... 523/160

* cited by examiner

*Primary Examiner*—Laura Edwards
(74) *Attorney, Agent, or Firm*—Edward P. Dutkiewicz

(57) ABSTRACT

A container with a quantity of coating liquid includes a luminescent pigment and a paint base. An impeller is in proximity to the bottom of the container to keep the pigment in suspension in the paint base. The container also has a linear inlet slot and a linear outlet slot. A feeding assembly includes a supply roll, a take up roll and a plurality of idler rolls to move a plurality of nylon straps from the supply roll, across the take up rolls and through the container and liquid therein and to the take up roll. A drying assembly is provided for nylon straps moving between the outlet slot and the take up roll. Also provided is a method and material.

5 Claims, 3 Drawing Sheets

FIG 1
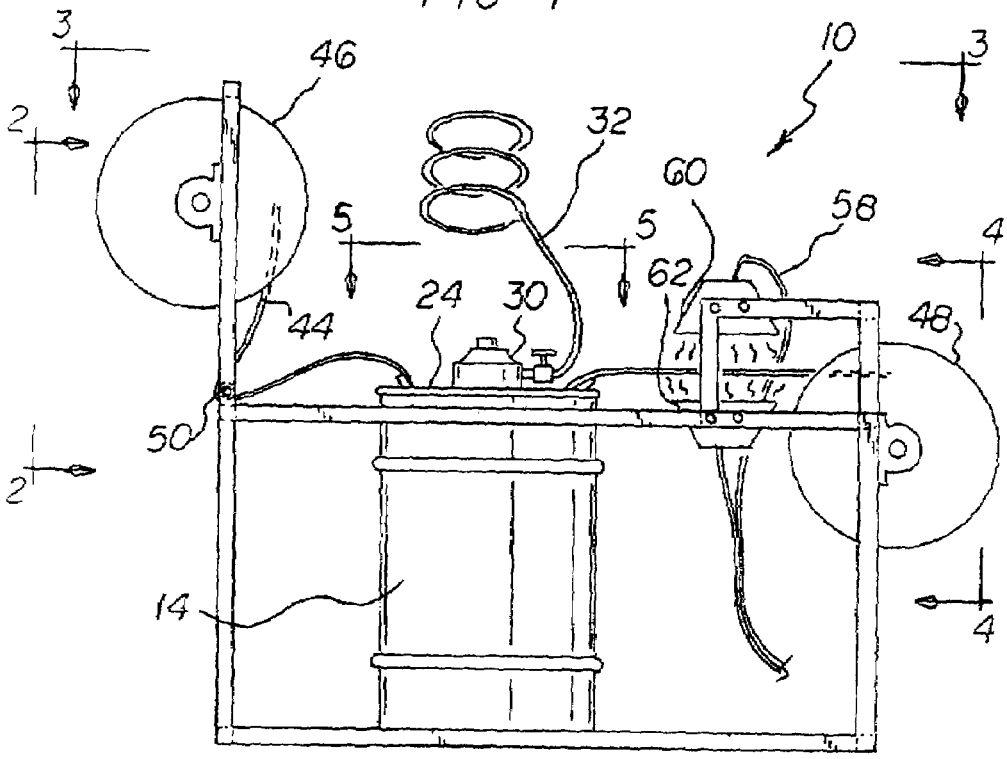
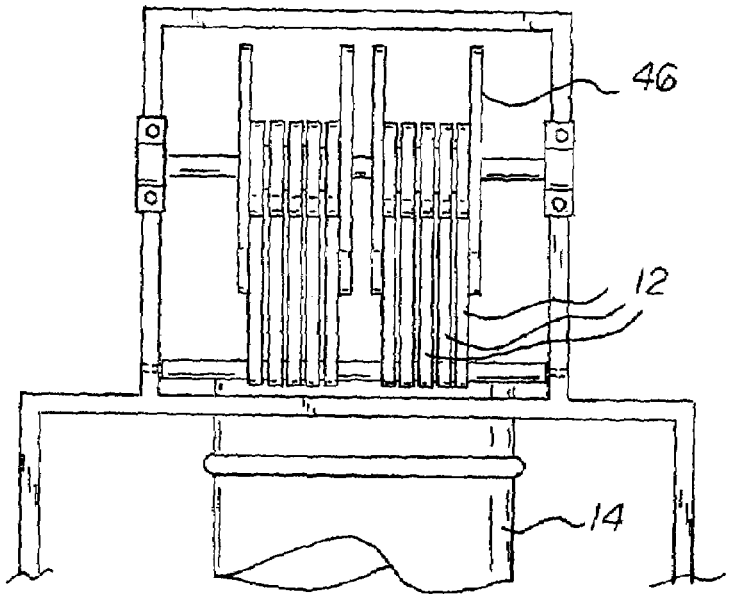
FIG 2

FIG 3
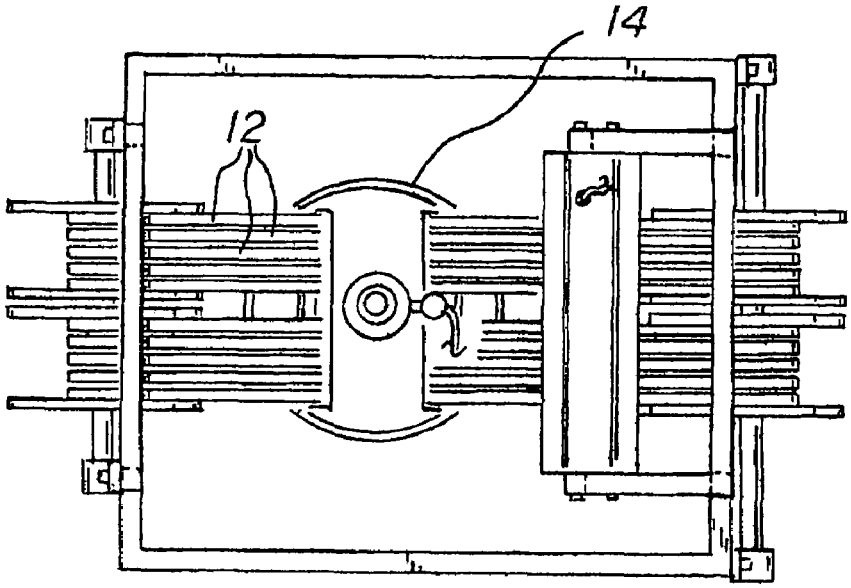
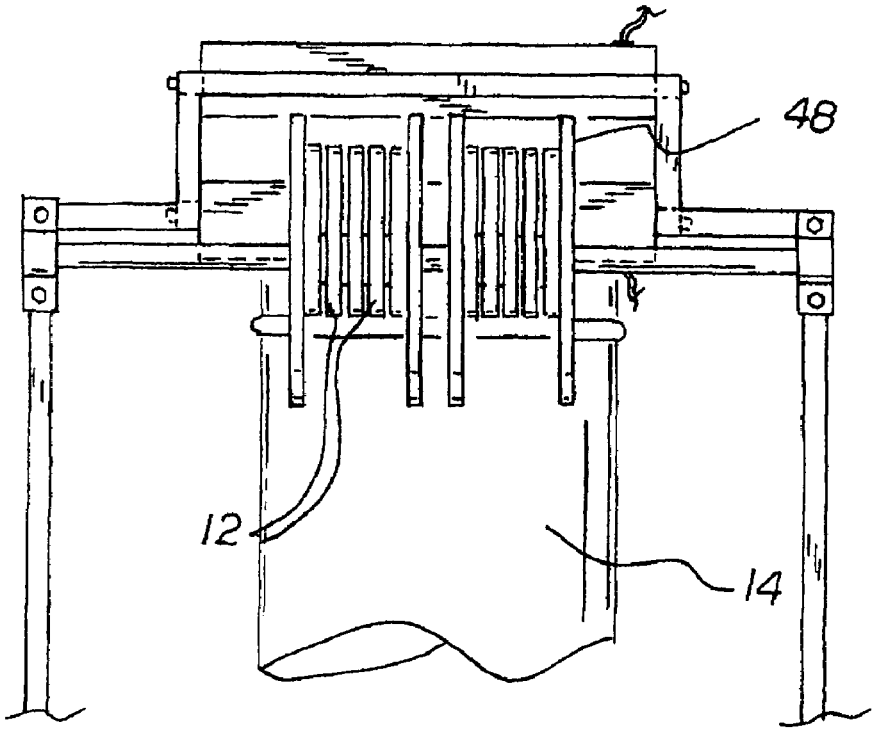
FIG 4

FIG 5
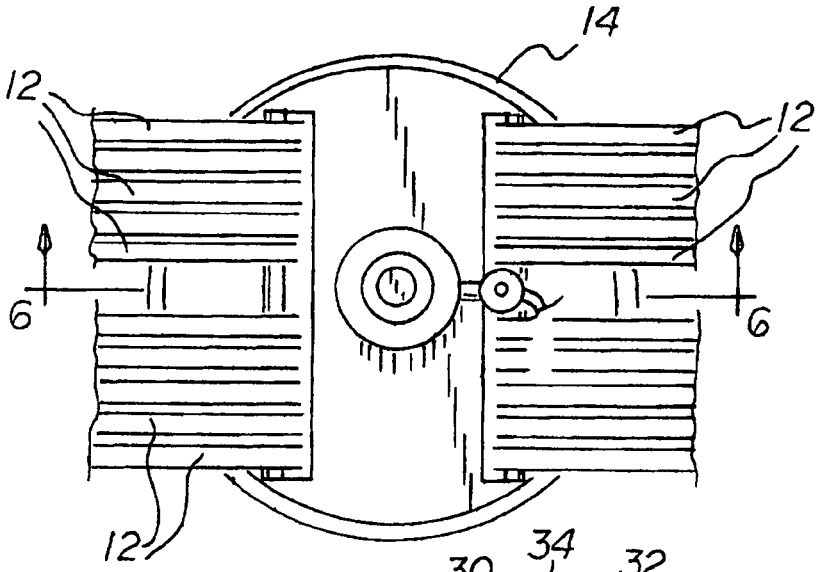
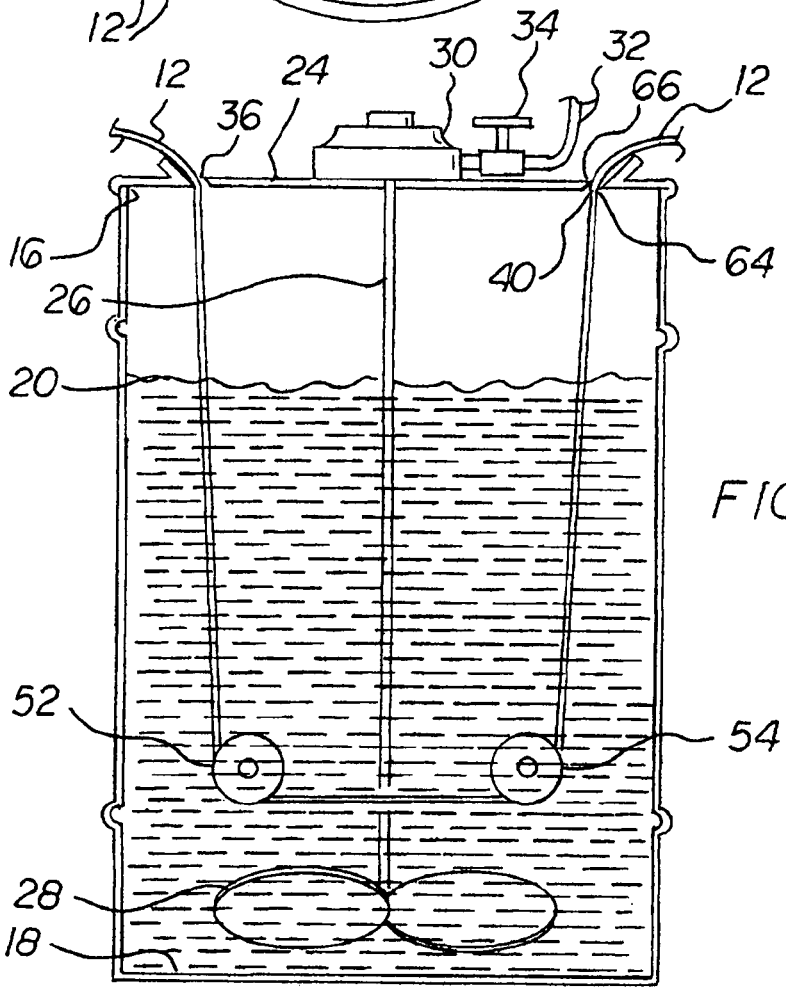
FIG 6

MIXING AND APPLICATION SYSTEM, METHOD AND MATERIAL

BACKGROUND OF THE INVENTION

1. Field of the Invention

The present invention relates to a mixing and application system, method and material and more particularly pertains to applying a luminescent coating to a nylon webbing.

2. Description of the Prior Art

The use of mixing and application systems, methods and materials of known designs and configurations is known in the prior art. More specifically, mixing and application systems, methods and materials of known designs and configurations previously devised and utilized for the purpose of mixing and applying luminous products through known designs and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,424,006 issued Jun. 13, 1995 to Murayama relates to a phosphorescent phosphor. U.S. Pat. No. 6,077,986 issued Jun. 20, 2000 to Hilston relates to a process for manufacturing tape products. Lastly, U.S. Pat. No. 6,264,855 issued Jul. 24, 2001 to Kitagawa relates to a process for preparing water resistant luminous pigments.

While these devices fulfill their respective, particular objectives and requirements, the aforementioned patents do not describe a mixing and application system, method and material that allows applying a luminescent coating to a nylon webbing.

In this respect, the mixing and application system, method and material according to the present invention substantially departs from the conventional concepts and designs of the prior art, and in doing so provides an apparatus primarily developed for the purpose of applying a luminescent coating to a nylon webbing.

Therefore, it can be appreciated that there exists a continuing need for a new and improved mixing and application system, method and material which can be used for applying a luminescent coating to a nylon webbing. In this regard, the present invention substantially fulfills this need.

SUMMARY OF THE INVENTION

In view of the foregoing disadvantages inherent in the known types of mixing and application systems, methods and materials of known designs and configurations now present in the prior art, the present invention provides an improved mixing and application system. As such, the general purpose of the present invention, which will be described subsequently in greater detail, is to provide a new and improved mixing and application system, method and material which has all the advantages of the prior art and none of the disadvantages.

To attain this, the present invention essentially comprises a container. The container is in a cylindrical configuration. The container has an open top and a closed bottom. The container has a quantity of coating liquid. The coating liquid includes one kilogram of a luminescent pigment. The luminescent pigment is preferably LUMILUX Green tm SN-F2 50095 pigment marketed by Honeywell Specialty Chemicals of Seelze, Germany. The coating liquid also includes one U.S. gallon of a paint base. The paint base is preferably VLX 14649-01. VLX 14649-01 is a clear vinyl plastisol marketed by Diamond Vogel Paint of Orange City, Iowa.

A circular lid is provided. The lid is removably positionable on the open top of the container. The lid has a rod extending downwardly from the center of the lid. An impeller is provided at the lower end of the rod in proximity to the bottom of the container. The lid also has a motor. The motor has a line source of power and a switch. The switch activates the motor to rotate the rod and the impeller. In this manner the pigment is kept in suspension in the paint base. The lid also has a linear inlet slot and a linear outlet slot. The inlet and outlet slots are parallel with each other on opposite sides of the rod.

Provided next is a feeding assembly. The feeding assembly includes a supply roll. The supply roll is located above the lid and to the side of the container adjacent to the inlet slot. The feeding assembly also includes a take up roll. The take up roll is located below the lid and to the side of the container adjacent to the outlet slot. The feeding assembly also includes a plurality of idler rolls. The idler rolls are parallel with each other and the supply and take up rolls. One of the idler rolls is located beneath the supply roll laterally off set from the container. The other idler rolls are located within the container laterally spaced from each other above the impellers. The take up roll is adapted to be coupled to a source of power to move a plurality of nylon straps from the supply roll, across the take up rolls and through the container and liquid therein and to the take up roll.

Provided last is a drying assembly for nylon straps moving between the outlet slot and the take up roll. The drying assembly includes infra red lamps above the webbings. The drying assembly further includes infra red lamps beneath the webbings for drying the pigment and paint base onto the webbings prior to being received on the take up roll. The drying assembly also includes a V-shaped bend. The V-shaped bend has a rubber surface on the side of the outlet slot proximate the take up roll. A V-shaped point is provided on the side of the outlet slot remote from the take up roll. The V-shaped bend and the V-shaped point constitute a squeegee to remove excess liquid from the webbings prior to movement of the webbings between the lamps.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mixing and application system, method and material which has all of the advantages of the prior art mixing and application systems, methods and materials of known designs and configurations and none of the disadvantages.

It is another object of the present invention to provide a new and improved mixing and application system, method and material which may be easily and efficiently manufactured and marketed.

It is further an object of the present invention to provide a new and improved mixing and application system, method and material which is of durable and reliable constructions.

An even further object of the present invention is to provide a new and improved mixing and application system, method and material which is susceptible of a low cost of manufacture with regard to both materials and labor, and which accordingly is then susceptible of low prices of sale to the consuming public, thereby making such mixing and application system, method and material economically available to the buying public.

Even still another object of the present invention is to provide a mixing and application system, method and material for applying a luminescent coating to a nylon webbing.

Lastly, it is an object of the present invention to provide a new and improved mixing and application system, method and material. A container with a quantity of coating liquid includes a luminescent pigment and a paint base. An impeller is in proximity to the bottom of the container to keep the pigment in suspension in the paint base. The container also has a linear inlet slot and a linear outlet slot. A feeding assembly includes a supply roll, a take up roll and a plurality of idler rolls to move a plurality of nylon straps from the supply roll, across the take up rolls and through the container and liquid therein and to the take up roll. A drying assembly is provided for nylon straps moving between the outlet slot and the take up roll.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a mixing and application system constructed in accordance with the principles of the present invention.

FIG. 2 is a left side elevational view of the system shown in FIG. 1 taken along line 2—2 of FIG. 1.

FIG. 3 is a plan view of the system shown in FIGS. 1 and 2 taken along line 3—3 of FIG. 1.

FIG. 4 is a right side elevational view of the system shown in the prior Figures taken along line 4—4 of FIG. 1.

FIG. 5 is a cross sectional view taken along line 5—5 of FIG. 1.

FIG. 6 is a cross sectional view taken along line 6—6 of FIG. 5.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved mixing and application system embodying the principles and concepts of the present invention and generally designated by the reference numeral 10 will be described.

The present invention, the mixing and application system 10 is comprised of a plurality of components. Such components in their broadest context include a container, an impeller, a feeding assembly, and a drying assembly. Such components are individually configured and correlated with respect to each other so as to attain the desired objective.

First provided is a container 14. The container is in a cylindrical configuration. The container has an open top 16 and a closed bottom 18. The container has a quantity of coating liquid 20. The coating liquid includes one kilogram of a luminescent pigment. The luminescent pigment is preferably LUMILUX Green tm SN-12 50095 pigment marketed by Honeywell Specialty Chemicals of Seelze, Germany. The coating liquid also includes one U.S. gallon of a paint base. The paint base is preferably VLX 14649-01. VLX 14649-01 is a clear vinyl plastisol marketed by Diamond Vogel Paint of Orange City, Iowa.

A circular lid 24 is provided. The lid is removably positionable on the open top of the container. The lid has a rod 26 extending downwardly from the center of the lid. An impeller 28 is provided at the lower end of the rod in proximity to the bottom of the container. The lid also has a motor 30. The motor has a line 32 source of power and a switch 34. The switch activates the motor to rotate the rod and the impeller. In this manner the pigment is kept in suspension in the paint base. The lid also has a linear inlet slot 36 and a linear outlet slot 40. The inlet and outlet slots are parallel with each other on opposite sides of the rod.

Provided next is a feeding assembly 44. The feeding assembly includes a supply roll 46. The supply roll is located above the lid and to the side of the container adjacent to the inlet slot. The feeding assembly also includes a take up roll 48. The take up roll is located below the lid and to the side of the container adjacent to the outlet slot. The feeding assembly also includes a plurality of idler rolls 50, 52, 54. The idler rolls are parallel with each other and the supply and take up rolls. One of the idler rolls 50 is located beneath the supply roll laterally off set from the container. The other idler rolls 52, 54 are located within the container laterally spaced from each other above the impellers. The take up roll is adapted to be coupled to a source of power to move a plurality of nylon straps from the supply roll, across the take up rolls and through the container and liquid therein and to the take up roll. As the webbing passes through the container it is immersed in the liquid for coating both sides of the webbings with a plurality of straps of the webbings on each side of the rod.

Provided last is a drying assembly 58 for nylon straps moving between the outlet slot and the take up roll. The drying assembly includes infra red lamps 60 above the webbings. The drying assembly further includes infra red lamps 62 beneath the webbings for drying the pigment and paint base onto the webbings prior to being received on the take up roll. The drying assembly also includes a V-shaped bend. The V-shaped bend has a rubber surface 64 on the side of the outlet slot proximate the take up roll. A V-shaped point 66 is provided on the side of the outlet slot remote from the take up roll. The V-shaped bend and the V-shaped point constitute a squeegee to remove excess liquid from the webbings prior to movement of the webbings between the lamps.

The mixing and application for the coatings utilized in the present invention involves mixing 1 U.S. gallon of VLX 14649-01. Added thereto is 1 kilograms of Honeywell Lumilux Green SN-12 50095 pigment. This mixture is then mixed in a non-metal container, preferably a plastic container. Altering from using a non-metal container results in a reaction between the pigment and the metal that turns the solution to a black color and then it is waste.

After the two parts are mixed in a plastic container, preferably a three gallon plastic container, the mixture is placed in a mixing device and the container is locked down. A special lid was developed to fit with a motorized stirring device which is attached thereto. The lid is secured and the nylon webbing is fed into a slot on one side of the lid. It is looped to the bottom of the solution so as to be fully submerged. The webbing is then fed up to the other side of the lid through a rubber squeegee type material that presses off the excess liquid material as it comes out of the container.

After the webbing is in place around the various rolls, the stirring process begins and continues throughout the complete process. Failure to do so will result in coated webbing that does not glow. The reason for this is the pigment is a very heavy substance and must be kept suspended at all times to evenly coat the webbing. After this is done the webbing is then pulled through and connected to empty take up spools around which it will wrap.

Another device is at this point that turns the threaded spools and, at the same time, it wraps the webbing into a new take up spool where it is pulled through the solvent mixture and out across infrared lights that immediately dry the solvents on the webbing. It is then re-spooled as this process continues. After the spool, which is normally 50 yards of material, is empty on the starting end, it is then finished at the other end and is now a glow-in-the-dark webbing.

The device is not limited to the amounts of rolls that it can do at one time and the speed is only limited to the drying time of the webbing as it passes across the lights. Total process is normally 15 minutes per run and can be as many as 10 rolls at a time.

The present invention may also be considered as including a method, the method of mixing and applying a coating of liquid to a base. Such method comprises the steps of first providing a container with a quantity of coating liquid including a luminescent pigment and a paint base. The next step of the method providing an impeller in proximity to the bottom of the container to keep the pigment in suspension in the paint base, the container also having a linear inlet slot and a linear outlet slot. The method then includes the step of feeding a base material from a supply roll to a take up roll and across a plurality of idler rolls to move the base material from the supply roll, across the take up rolls and through the container and liquid therein and to the take up roll. Lastly, the method includes the step of drying the base material at a location between the outlet slot and the take up roll.

In the method, the base material is preferably a plurality if straps of nylon webbing. In the method, the liquid preferably includes two components in the ratio of one kilogram of a luminescent pigment to one U.S. gallon of a paint base.

The final feature of the invention is the material utilized in applying a coating of liquid to a base such as a nylon webbing. The liquid includes two components in the ratio of about one kilogram of a luminescent pigment to one U.S. gallon of a paint base.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A mixing and application system for applying a luminescent coating to nylon straps comprising, in combination:

a container in a cylindrical configuration with an open top and a closed bottom and with a quantity of coating liquid including one kilogram of a luminescent pigment and one U.S. gallon of a paint base;

a circular lid removably positionable on the open top of the container, the lid having rod extending downwardly from the center of the lid with an impeller at the lower end of the rod in proximity to the bottom of the container, the lid also having a motor with a line to a source of power and a switch for activating the motor to rotate the rod and the impeller to keep the pigment in suspension in the paint base, the lid also having a linear inlet slot and a linear outlet slot, the inlet and outlet slots being parallel with each other on opposite sides of the rod;

a feeding assembly including a supply roll located above the lid and to the side of the container adjacent to the inlet slot, the feeding assembly also including a take up roll located below the lid and to the side of the container adjacent to the outlet slot, the feeding assembly also including a plurality of idler rolls parallel with each other and the supply and take up rolls, one of the idler rolls being located beneath the supply roll laterally off set from the container with the other idler rolls being located within the container laterally spaced from each other above the impeller, the take up roll adapted to be coupled to a source of power to move a plurality of the nylon straps from the supply roll, across the take up rolls and through the container and liquid therein and to the take up roll; and a drying assembly for nylon straps moving between the outlet slot and the take up roll, the drying assembly including infra red lamps above the nylon straps and infra red lamps beneath the nylon straps for drying the pigment and paint base onto the nylon straps prior to being received on the take up roll, the drying assembly also including a V-shaped bend with a rubber surface on the side of the outlet slot proximate the take up roll and a V-shaped point on the side of the outlet slot remote from the take up roll, the V-shaped bend and the V-shaped point constituting a squeegee to remove excess liquid from the nylon straps prior to movement of the nylon straps between the lamps.

2. A mixing and application system comprising:

a container with a quantity of coating liquid including a luminescent pigment and a paint base;

an impeller in proximity to the bottom of the container to keep the pigment in suspension in the paint base, the container also having a linear inlet slot and a linear outlet slot;

a feeding assembly including a supply roll and a take up roll and a plurality of idler rolls to move a plurality of nylon straps from the supply roll, across the take up rolls and through the container and liquid therein and to the take up roll; and a drying assembly for nylon straps moving between the outlet slot and the take up roll, the drying assembly also including infra red lamps above the nylon straps and infra red lamps beneath the nylons straps for drying the pigment and paint base onto the nylon straps prior to being received on the take up roll, the drying assembly also including a V-shaped bend with a rubber surface on the side of the outlet slot proximate the take up roll and a V-shaped point on the side of the outlet slot remote from the take up roll, the V-shaped bend and the V-shaped point constituting a squeegee to remove excess liquid from the nylon straps prior to movement of the nylon straps between the lamps.

3. The system as set forth in claim 2 wherein the quantity of coating liquid includes one kilogram of a luminescent pigment and one U.S. gallon of a paint base.

4. The system as set forth in claim 2 wherein the container includes a removable lid with the slots being formed in the lid.

5. The system as set forth in claim 4 wherein the container includes a rod with a lower end supporting the impeller and an upper end supported by the lid.

* * * * *